US007552608B2

(12) United States Patent
Field et al.

(10) Patent No.: US 7,552,608 B2
(45) **Date of Patent: *Jun. 30, 2009**

(54) LOCK, KEY BLANK, AND KEY OF A HIERARCHICAL LOCK SYSTEM

(75) Inventors: Peter H. Field, Salem, VA (US); Steve Poff, Roanoke, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/141,427

(22) Filed: Jun. 18, 2008

(65) Prior Publication Data

US 2008/0250830 A1 Oct. 16, 2008

Related U.S. Application Data

(63) Continuation-in-part of application No. 11/694,097, filed on Mar. 30, 2007, now Pat. No. 7,412,860.

(51) Int. Cl.
*E05B 19/06* (2006.01)

(52) U.S. Cl. ..... 70/340; 70/347; 70/406; 70/407; 70/409; 70/420; 70/453; 70/493

(58) Field of Classification Search ..... 70/405–407, 70/409, 420, 453, 454, 347, 337–343, 493–495; D8/347, 348
See application file for complete search history.

(56) References Cited

U.S. PATENT DOCUMENTS

| | | | |
|---|---|---|---|
| 263,244 | A | 8/1882 | Taylor |
| 420,174 | A | 1/1890 | Taylor |
| 567,305 | A | 9/1896 | Donovan |
| 608,069 | A | 7/1898 | Noack |
| 1,679,558 | A | 8/1928 | Best |
| 2,068,936 | A | 1/1937 | Unterberg |
| 2,279,592 | A | 4/1942 | Machinist |
| 2,440,428 | A | 4/1948 | Best |
| 2,440,429 | A | 4/1948 | Best |
| 2,591,652 | A | 4/1952 | Ziegliss |
| 2,662,390 | A | 12/1953 | Michnoff et al. |

(Continued)

FOREIGN PATENT DOCUMENTS

| | | | |
|---|---|---|---|
| DE | 2828343 | A1 | 1/1980 |

*Primary Examiner*—Lloyd A Gall
(74) *Attorney, Agent, or Firm*—Rothwell, Figg, Ernst & Manbeck, PC

(57) ABSTRACT

A lock system includes keys, key blanks, keyways, and lock cylinders, and the keys or key blanks have opposite sides formed with grooves for cooperating with a conforming keyway. More particularly, the sides of the key or key blank have a portion grooved for registration, another portion grooved for top-level hierarchical master keying, and two other portions, one on each side of the blade, for further master key variations and different combinations. One of the two further sections being curvilinear and the other rectangular or angular cuts. The conforming keyway of the lock includes ridges and grooves corresponding to the grooves and ridges, respectively, of the key or key blank. Instruments other than keys or key blanks may be used to enter the grooves and ridges of the keyway to operate the lock without the use of a precisely configured key.

16 Claims, 13 Drawing Sheets

U.S. PATENT DOCUMENTS

| | | | |
|---|---|---|---|
| 3,276,233 | A | 10/1966 | Russell et al. |
| 3,499,302 | A | 3/1970 | Spain et al. |
| 3,499,304 | A | 3/1970 | Naujoks |
| 3,722,240 | A | 3/1973 | Spain et al. |
| 4,103,526 | A | 8/1978 | Surko |
| 4,168,617 | A | 9/1979 | Prunbauer |
| 4,356,713 | A | 11/1982 | Widen |
| 4,368,629 | A | 1/1983 | Prunbauer |
| 4,393,673 | A | 7/1983 | Widen |
| 4,416,128 | A | 11/1983 | Steinbrink |
| 4,635,455 | A | 1/1987 | Oliver |
| 4,653,298 | A | 3/1987 | Tietz |
| 4,683,740 | A | 8/1987 | Errani |
| D325,160 | S | 4/1992 | Best et al. |
| D327,635 | S | 7/1992 | Best et al. |
| 5,287,712 | A | 2/1994 | Sieg |
| 5,289,709 | A | 3/1994 | Field |
| 5,419,168 | A | 5/1995 | Field |
| 5,490,405 | A | 2/1996 | Ramo et al. |
| D368,846 | S | 4/1996 | Myers et al. |
| 5,570,601 | A | 11/1996 | Field |
| 5,615,565 | A | 4/1997 | Field |
| 5,715,717 | A | 2/1998 | Widen |
| 5,809,816 | A | 9/1998 | Widen |
| 6,023,954 | A | 2/2000 | Field |
| 6,145,357 | A | 11/2000 | Stefanescu |
| 6,477,875 | B2 | 11/2002 | Field et al. |
| 6,851,292 | B2 | 2/2005 | Kruhn |
| 6,945,082 | B2 | 9/2005 | Field et al. |
| 7,412,860 | B1 * | 8/2008 | Field et al. ..... 70/340 |

* cited by examiner

LOCK, KEY BLANK, AND KEY OF A HIERARCHICAL LOCK SYSTEM

CROSS REFERENCE TO RELATED APPLICATION

This application is a continuation-in-part of U.S. Pat. application Ser. No. 11/694,097, filed Mar. 30, 2007, now U.S. Pat. No. 7,412,860, the disclosure of which is hereby incorporated by reference.

FIELD OF THE INVENTION

This invention relates to improvements in keys, key blanks, keyways, and lock cylinders, particularly with regard to defining the profiles of keys, key blanks, and keyways using the shapes of ridges or grooves in a generally flat rectangular key blade profile. The shape of the key blank and key, of course, determines the shape of the keyway in a lock cylinder plug.

BACKGROUND AND PRIOR ART

The lock cylinders art is requiring higher and higher security and there is a need in the art for the development of a shape or profile of a cross section of key and corresponding shape of the keyway in the cylinder plug to accommodate a hierarchical lock providing high security. The shape of the keyway is the first barrier that rejects or filters an unauthorized key in attempt to operate the lock cylinder.

There is only a finite space in a lock cylinder plug that can be occupied by the key and that space must be structured to allow for the maximum number of unique keyway shapes to be able to develop lock systems of adequate size. In large modern lock systems it is usual to arrange the structure of the keyways in a manner so that at least three levels of a hierarchical system can be provided, with one master key blank at the top level of the system, some sub-master key blanks at a medium level and several change key blanks at the lowest level of the hierarchical system. A new key section design must be different from prior key sections so that the key blanks can be controlled by the manufacturer and the end user can benefit from the security offered by the exclusivity of this key control via the key blanks.

Unique key profile shapes provide for additional protection against unauthorized key copying. Most key blanks of the generally flat rectangular key profiles are manufactured with single pass formed milling cutters that shape the side of the key blank. The axis of rotation of the cutter is held parallel to the side of the blade. Keys using an undercut groove profile require additional form cutting on specially designed machines that are usually not available at commercial duplicator operations and thus the blanks are more difficult to copy or counterfeit.

Early in the development of lock cylinders, it became apparent that there were specific parameters that affected the size of the lock cylinder systems that could be developed and that there were many design factors that influenced the wear of the key and the cylinder and thus the longevity of the system. Key blanks were designed with these parameters in mind. Representative examples of the prior art include the following:

In U.S. Pat. No. 0,263,244, Taylor discloses a key blank design that offers an economically simple solution to the problem of having a key that moves too freely in the keyhole. This offers a very minimal keyway shape in the plug and key profile in the blank.

In U.S. Pat. No. 0,420,174, Taylor teaches a unique but limited master keying technique that uses a Y shaped key section in a plug that allows two differently shaped key profiles to contact their own areas of the non rotating tumbler pins.

In U.S. Pat. No. 0,567,305, Donavan discloses a method of expanding the number of key sections, thus increasing the available size of lock systems, by dividing the key blank height into various areas and using consistent warding techniques at these locations to develop hierarchical keyways or key profiles. This increases the system size of pin tumbler cylinders. The bittings of one key can be repeated on a different key blank, configured with a different key profile, and the cylinders into which these individual keys fit can also be operated by a higher level key designed to insert into both of the keyways.

In U.S. Pat. No. 0,608,069, Noack discloses an arrangement of key section warding that provides improved wear on the key and the key contact area on the tip of the locking pins. In addition it provides a narrow cross sectional width under the bitting area, thus making it difficult to manipulate pick tools under the tumbler pins.

In U.S. Pat. No. 3,499,304, M. Noujoks teaches a method of designing key section warding where both faces of the keys are provided with alternating ridges and grooves. It utilizes a master key blank that has all the grooves of the series but not the ridges, while the key blanks of a lower hierarchical level have varying ridges.

In U.S. Pat. Nos. 4,168,617 and 4,368,629, Prunbauer discloses more methods of designing key section warding where the master key will fit into the subordinate keyways but the lower keys will not fit into the master keyways. In one embodiment, the ridges and grooves defining the key section are of a rectangular cross-section shape, and the outwardly projecting variable ridge on the subordinate key extends laterally beyond any of the other variable ridges. The subordinate key is thicker at its further ridge than the master key is at any location. In another embodiment the master key is formed of a zigzag shape, that is with its opposite sides formed of a plurality of planar facets each of which is substantially parallel to a respective planar facet on the other side.

In U.S. Pat. No. 4,416,128, Steinbrink teaches another unique method of designing key sections where the longitudinal grooves on both sides of the key blank are formed with bottom faces that lay substantially along the arc of a circle.

In U.S. Pat. No. 4,653,298, Tietz discloses a method of designing master key section warding that incorporates an invariable or family profile near the bitting area on the blank, and the variations defining the individual key sections are located near the spline or bottom edge of the blank. Additionally there are at least two profile formations that cross a center line in the key blank, one ridge is extending beyond the surface of the blank, and the variations are made with longitudinal grooves having rectangular cross sections.

In U.S. Pat. No. 4,683,740, Errani illustrates a key section design that has a undercut groove shape making it very difficult to manipulate a pick tool in the keyway of the plug. The undercut groove is formed by means of cutters having their rotational axis inclined in relation to the sides of the key blank.

In U.S. Pat. Nos. 5,715,717 and 5,809,816, Widen teaches some very specific methods of designing key sections using a three sided undercut groove located closest to the bottom edge of the key blank and extending inwardly inclined towards the bottom of the key blank, or using an undercut groove with a substantially flat surface which is inclined towards the groove bottom surface.

In U.S. Pat. No. 6,145,357, Stefanescu teaches a method of designing master key section warding that utilizes a key blank with a T-shaped cross sectional area with all the profile ribs having specific curvilinear cross sectional contours, with rounded front and flank portions.

In U.S. Pat. No. 6,851,292, Kruhn discloses a method of designing lock and key warding that incorporates specific perpendicular groove surfaces on one side of the key section, and slanting surfaces on the other side that are positioned in a relationship designed to trap, or limit the motion of a picking tool inserted into the key way.

While the prior art has developed usable key sections, they fail to maximize the area of the plug and do not allow for the development of many large master keying systems.

SUMMARY OF THE INVENTION

This invention provides specific parameters for key section profiles and the corresponding keyways in a cylinder plug that allows for the development of many exclusive and non-interchangeable hierarchical master key systems. In order to accomplish this, the keyway and conforming key blade are considered separately for three vertical sections from the bottom edge of the keyway and blade up to the top edge of the blade. Each of the three sections is contoured or formed with specific variations of ridges and grooves that establish the lock's and key blank's positions within a hierarchical system or systems. The first, bottommost section of the blade has a registry groove for the positioning of any secondary side milling operations used in the manufacture of the blank, and the keyway has a conforming ridge in its bottommost section. This registry groove in the blade also allows for exact positioning of the blank in a key cutting or bitting machine. A second vertical section of the blade has at least one undercut longitudinal groove on at least one side of the blade, and the keyway has a conforming ridge or ridges in its second vertical section. The location and shape of the undercut groove in the second section of the blade determines the primary family of the hierarchical system. The third section of the blade, just below the bitting surface, may be divided into two sides. One of these sides has a variation of the key section profile determined by using longitudinal grooves of curved shaped forms that are shifted up and down the side of the blade to create the necessary variations. The position and curved form of the profiles on this side determines the secondary and subgroups in the family of the hierarchical system. On the other side of the third, or topmost section, of the blade, the variations in the key section profiles are determined by using longitudinal grooves having substantially rectangular or straight angular cross sections that vary in depth into the side of the blade. The position and depth of the angular profiles on this third section determine the individual location in the subgroup in the hierarchical system. The third section of the keyway has conforming curved ridges and grooves on one side thereof and conforming straight angular or rectangular ridges on the opposite side thereof.

By using these different but specific warding techniques at defined sections and on different sides of the blade it is possible to develop a structured system to allow the maximum number of new and unique key profile shapes. Additionally, by reversing the warding structure from side to side of the blade within different sections, it is possible to significantly increase the already large number of non-interchangeable key systems available, each providing adequate system size for the demands of modern security cylinder users.

DETAILED DESCRIPTION OF THE PREFERRED EMBODIMENTS

Figure 1:
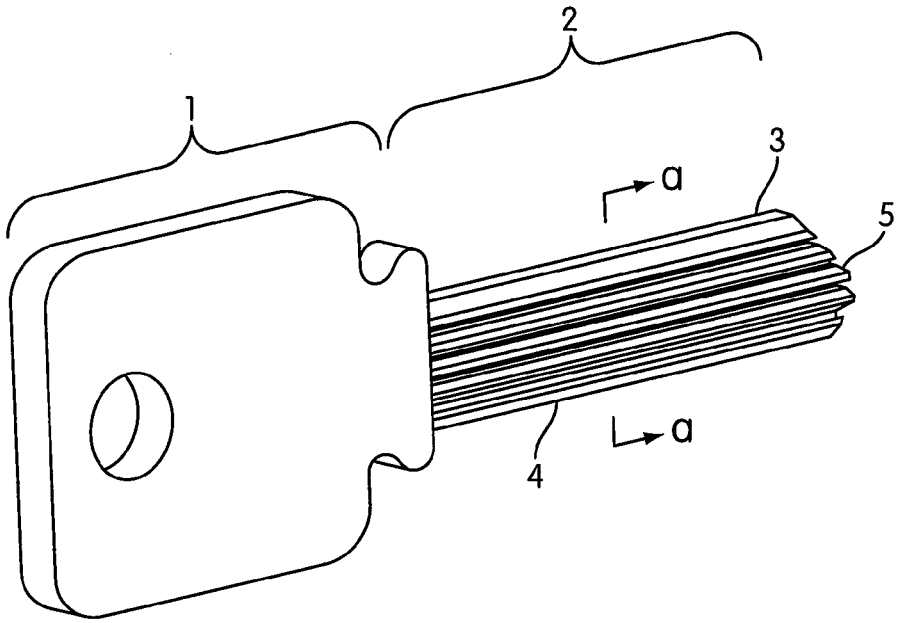
FIG. 1 is a perspective view of a key blank of this invention.

FIG. 1 shows a perspective view of a key blank according to this invention. The key blank has a head or bow 1 for holding and turning the key and a blade 2 for inserting into a keyway of a lock cylinder. The keyway of the lock cylinder has a profile matching the profile of the key blade. The key blade has a top surface 3 into which key bittings (not shown) are cut to position elements such as pin tumblers in a lock cylinder as is well known in the art, see for example the patent to Medeco Security Locks U.S. Pat. No. 5,419,168. The blank has a bottom surface 4 and an end tip 5. The end tip 5 may have a stop or other configuration; see for example U.S. Pat. No. 1,679,558.

Figure 2:
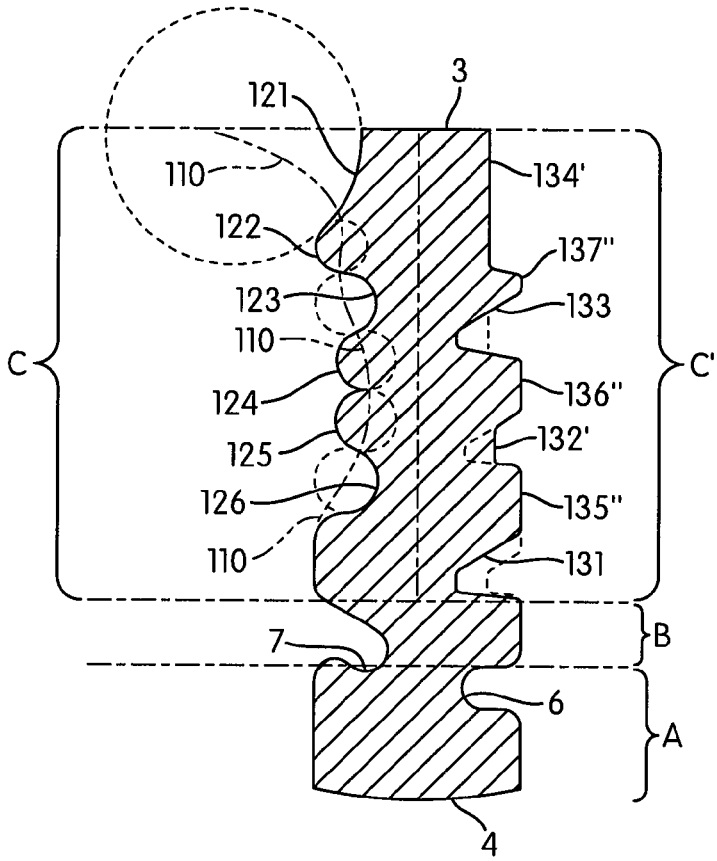
FIG. 2 is a cross-sectional view taken along line a-a of FIG. 1 and enlarged.

The cross section of the key blank in one configuration is shown in FIG. 2. FIG. 2 shows the top of the key blank blade 3 and the bottom of the key blank blade 4 and as shown in phantom lines three different sections. Section A, B, C and C'.

As shown, Section A is adjacent to the bottom of the blade, Section C and C' are adjacent to the top of the blade and Section B is in between Section A and Section C and C'.

Section A contains a groove 6 extending the length of the blade for registry purposes. When a key blank is being cut with bittings or machined for other grooves, registry groove 6 is used to provide a location for further operations relative to such groove.

In Section B there is an undercut groove 7 also extending the length of the blade. The undercut groove may be used to provide a first level in the hierarchical scheme for hierarchical master keying.

The area above the undercut groove is divided into the two sides C and C' and the shapes and configurations of the grooves and ridges extending along these two sides are established by distinctly different parameters. The shapes in Section C are determined by a base curvilinear shape 110 on which is overlaid a number of partial circular curves 121, 122, 123, 124, 125 and 126. These curves are all centered along the baseline 110. The curves can project either outwardly as convex ridges or inwardly as concave grooves from the baseline creating either curved longitudinal ridges or curved longitudinal grooves along the side of the blank of Section C and below the top surface 3. Similar families of curved shapes can be determined by variations in the base curvilinear shape 110, i.e., a different curvilinear shape 110 can function as a center line for the various circular curves. Subgroups of these secondary families may be predetermined by the presence of either curved ridges, e.g., 122, 124, 125, or curved grooves, e.g., 121, 123, 126, and also by moving the base curvilinear shape 110 either up or down the side of the blank in relation to the registry groove 6 in Section A.

The shapes of the side of the key blade in Section C' are determined by providing rectangular sections such as 134' and straight angular shapes such as 131, 132' and 133 and by varying the depths of these shapes into the side of the blank. There are a large number of other locations to provide grooves in Section C' on this side of the blank, for example areas 135", 136" and 137". The size of the grooves and the depths of the grooves that are formed in Section C' on this side of the blank determine the individual position of the key cut from the key blank in the family hierarchical structure.

Figure 3:
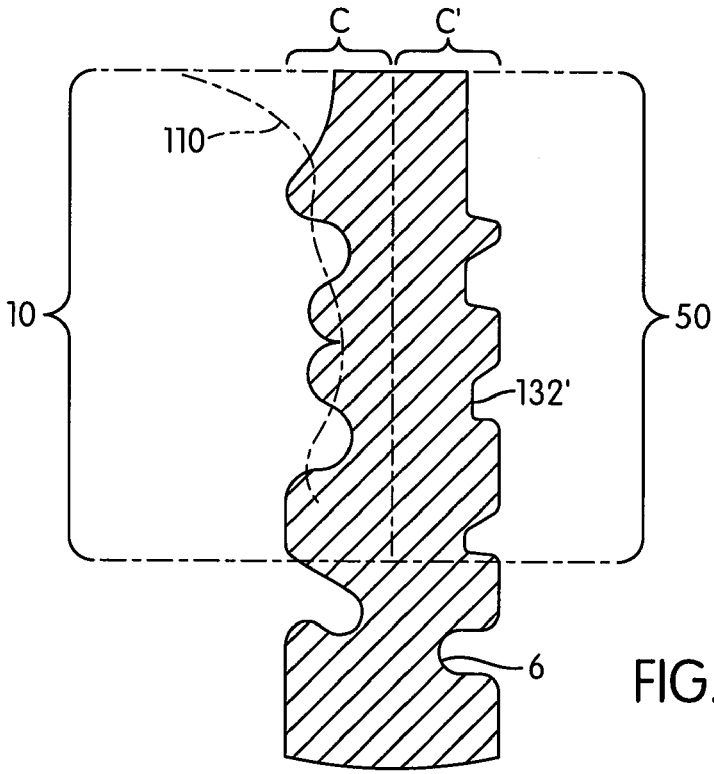
FIGS. 3 through 9 are cross-sectional views of other key configurations on the sides of the key blanks of this invention that illustrate the features of this invention.

FIG. 3 shows the same cross-sectional view of the key blank but illustrates the base curve 110 shifted vertically in relation to registry groove 6 to produce a profile 10 in Section C on one side of the blade. The rectangular and straight angular shapes in Section C' on the other side of the blade has variations, as compared to the key blank of FIG. 2, which define profile 50.

Figure 4:
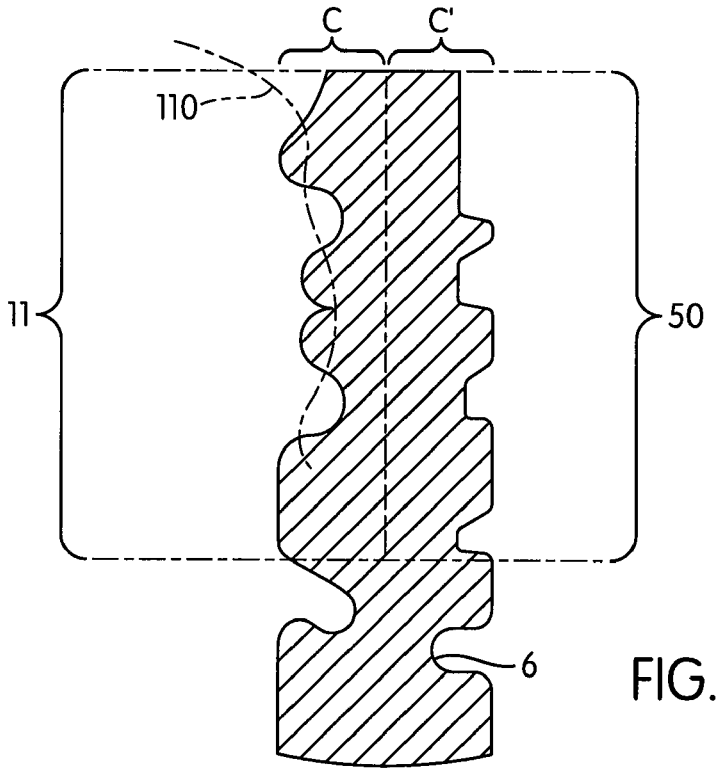

FIG. 4 illustrates another key blank variation in which the base curve 110 is positioned at a different height in relation to the registry groove 6 for cutting the area on the side in Section C producing a profile indicated at 11. The other side of the key blank in FIG. 4 in Section C' has a profile 50 showing the differences in cutting grooves and producing ridges.

Figure 5:
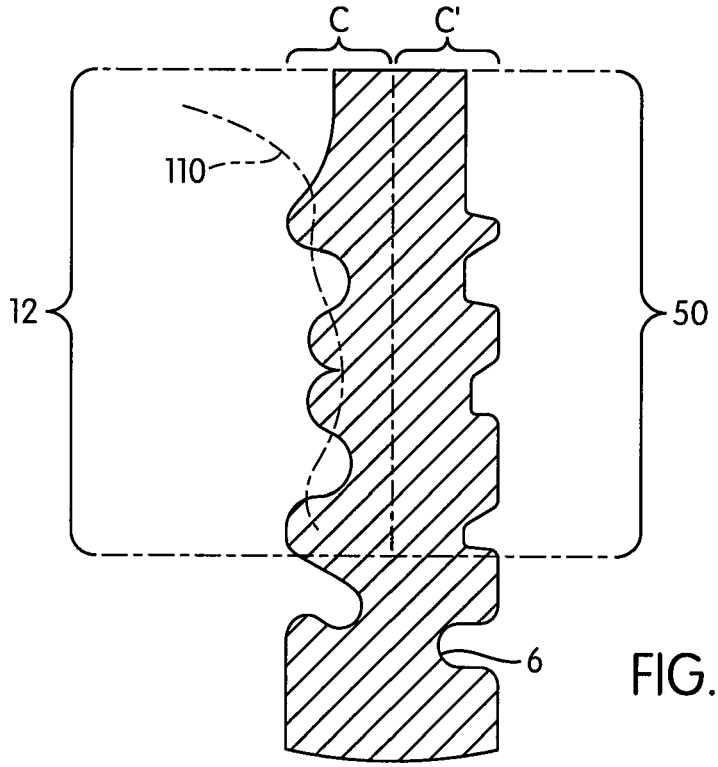

FIG. 5 is a further cross-sectional view of the key blank illustrating the base curve 110 producing profile 12 on Section C of the key blank and profile 50 on the other side in Section C' of the key blank. Profile 12 differs from profile 10 in FIG. 3 and profile 11 in FIG. 4 in that the base curve 110 is positioned at a different height relative to the registry groove 6.

Figure 6:
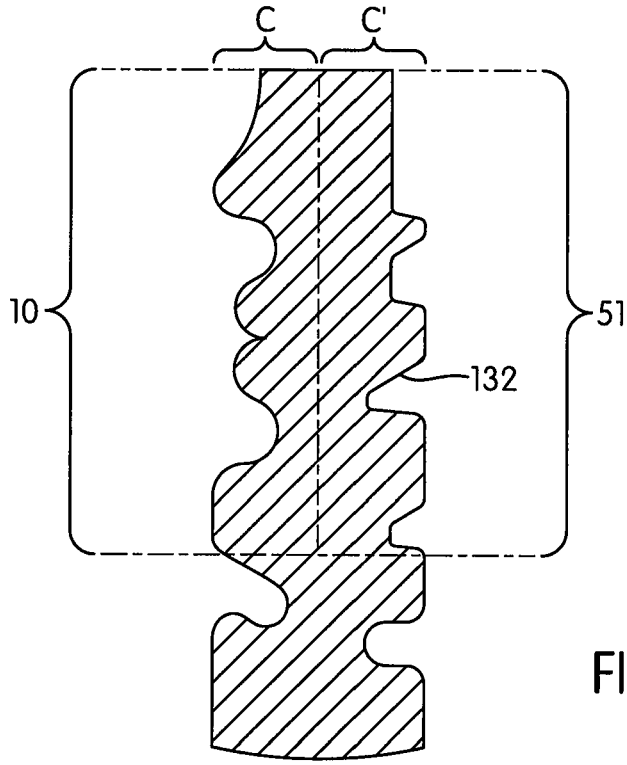

FIG. 6 is a cross-sectional view of the key blank illustrating a profile 10 in Section C and profile 51 in Section C'. Profile 51 differs from profile 50 in that groove 132 projects deeper into the side of the blank than groove 132' of FIG. 3.

Figure 7:
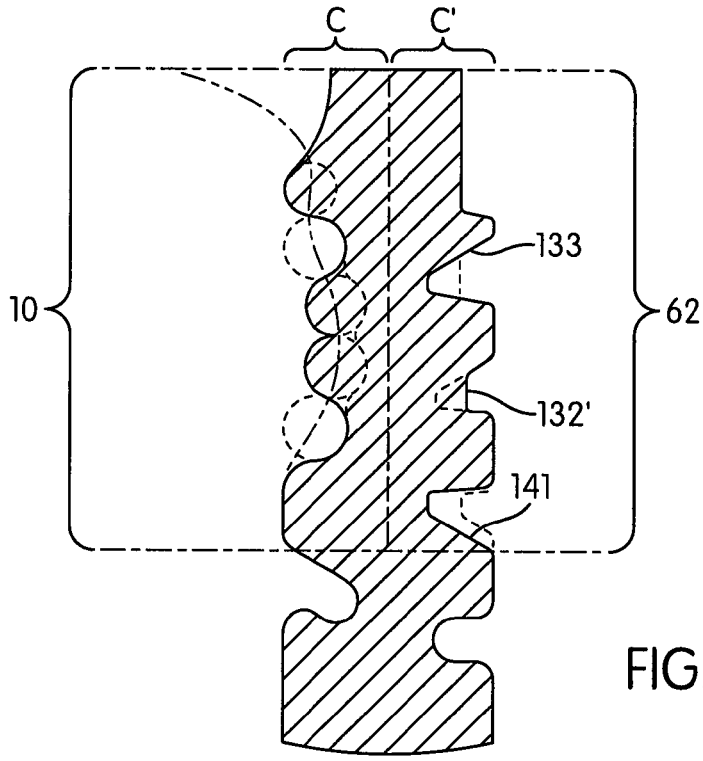

FIG. 7 is a cross-sectional view of a key blank illustrating profile 10 on Section C of the key blank and profile 62 on the other side in Section C'. Profile 62 differs in that groove 141 projects into the side of the blank at a different straight angular shape than groove 131 in FIG. 2.

Figure 8:
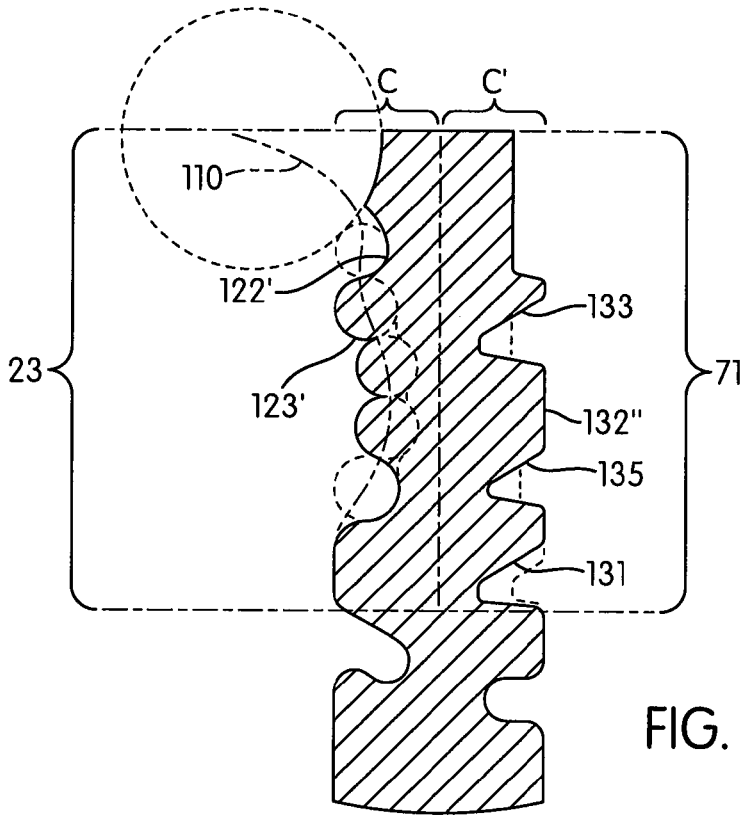

FIG. 8 is a further illustration of a cross-sectional view of a key blank illustrating a profile 23 in one side of the bitting area of the blade in Section C and profile 71 on the other side of the blade in Section C'. In Section C the base curve 110 is the same as shown in FIG. 2, however the curved groove 123 is changed to a curved ridge 123' and the curved ridge 122 is changed to a curved groove 122'. These changes produce a different sub-grouping of the secondary families of the key blank hierarchical structure. In Section C' of the blank in FIG. 8 there is no groove in the area 132" and there is a straight angular groove 135. The straight angular grooves 131, 133 and 135 determine the individual position of the blank in the hierarchical structure.

Figure 9:
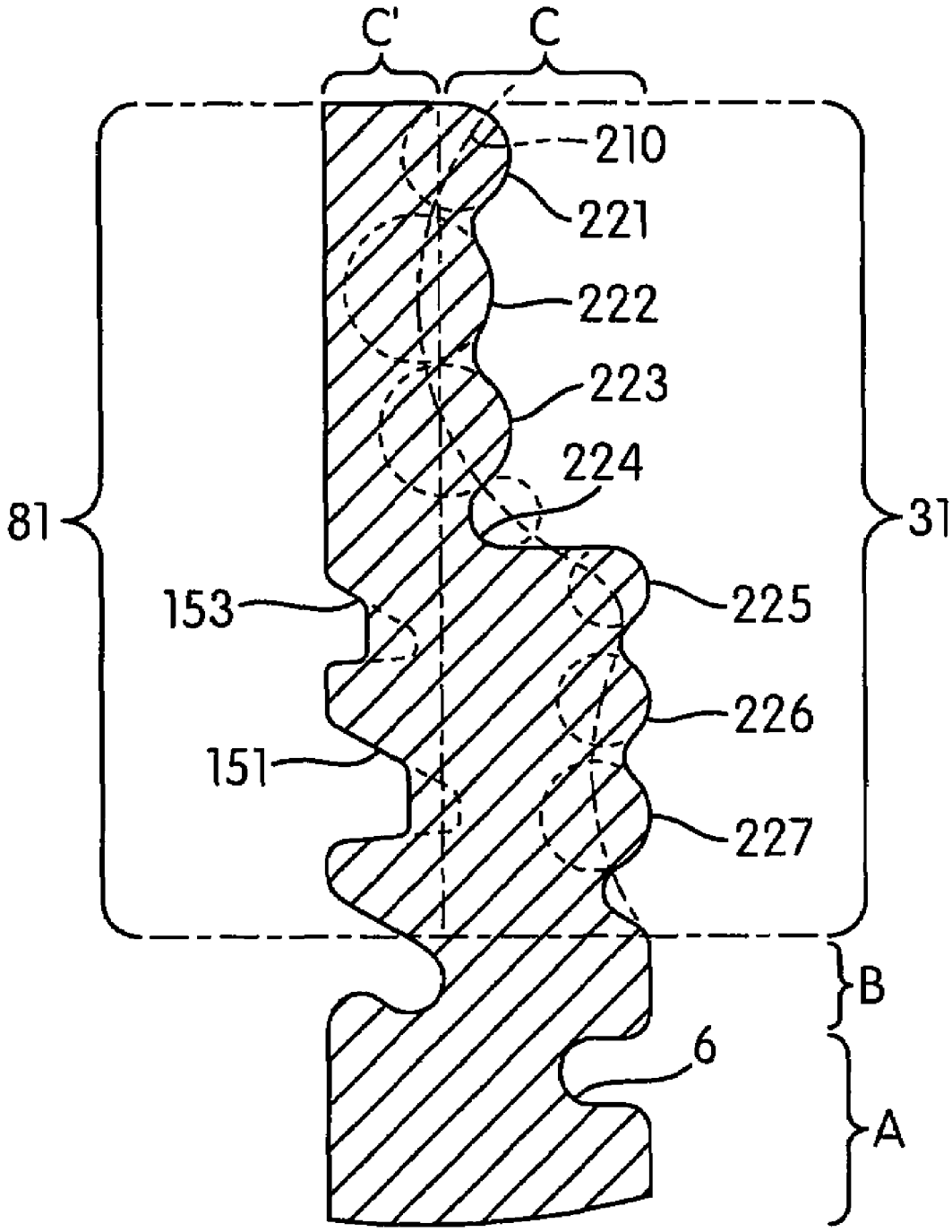

FIG. 9 is a cross-sectional view of another variation of the key blank showing profile 31 in Section C and profile 81 in Section C'. Base curve 210 of profile 31 determines the location of partial circular curves 221-227 that extend as curve grooves 224 or curve ridges 221, 222, 223, 225, 226, 227 along the length of the key blade. Secondary families of the curved shapes are determined by variations in the base curvilinear shape. The subgroups of these secondary families are determined by the presence of either curved ridges or curved grooves and by the position of the base curvilinear shape up or down the side of the blank in relation to the registry groove 6 in Section A. In profile 81 there are only two cut grooves 151 and 153 showing further possible variations.

Figure 10:
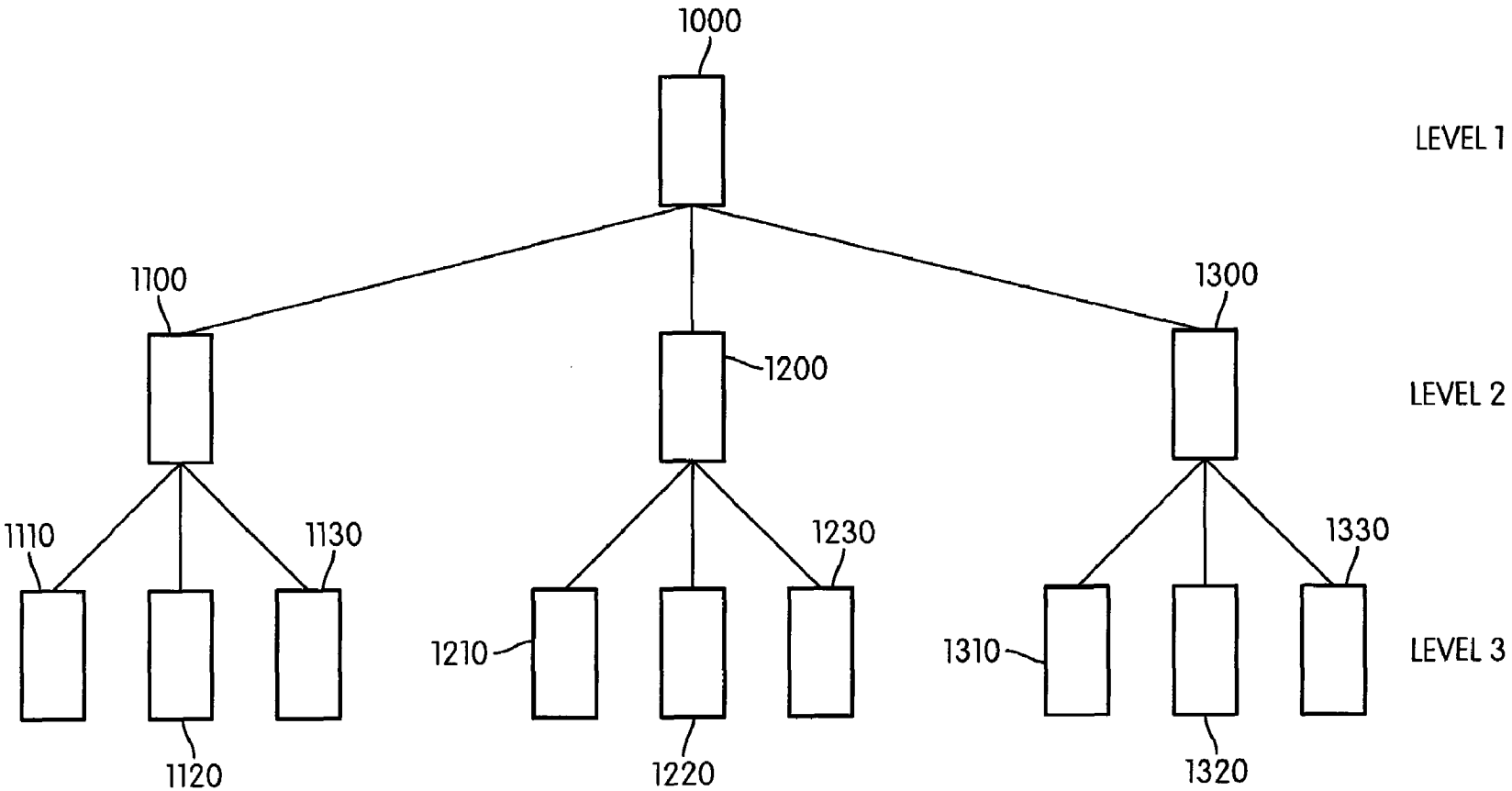
FIG. 10 PRIOR ART
FIG. 10 is an illustrative diagram of a simple three level hierarchical structure of keyways.

FIG. 10 is an illustrative diagram of a simple three-level hierarchical structure of keyways. A key blank that is configured to fit exactly in the top most key section 1000 is structured to also fit in all of the subordinate keyways. A key blank that is configured to fit exactly in one of the secondary level keyways, e.g., 1300, will also fit into all of the subordinate keyways 1310, 1320, 1330 of secondary level keyway 1300, but not into any of the third level keyways 1110, 1120, 1130 of secondary keyway 1100 or 1210, 1220, 1230 of secondary keyway 1200. The keys that will fit in the lowest level of the keyways Level 3 will not fit in any of the higher level keyways. This fit or not fit determination is accomplished not by the bitting at the top of the keys as is typical in prior art (although such could be used to further provide hierarchical structure) but, is provided by the grooves extending along the sides of the key blank as described above.

Figure 11A:
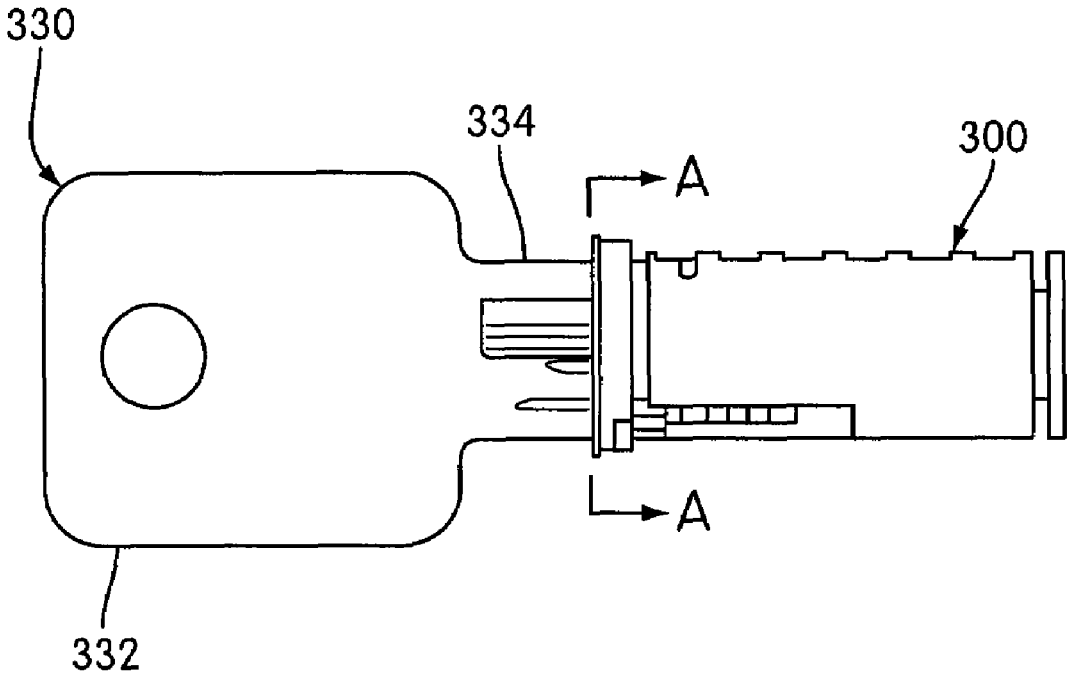
FIG. 11*a* is a side view of a key inserted into a lock cylinder.

FIG. 11*a* shows a cylinder lock 300 embodying aspects of the present invention into which a key 330, such as a key described above, is inserted in the keyway. Key 330 includes a bow 332 and a blade 334. The cylinder lock 300 may be part of a lock assembly further including a cylinder housing rotatably supporting the cylinder 300 as well as tumbler pins, sliders, and other mechanisms (not shown) for preventing rotation of the cylinder within the cylinder housing until a properly configured key or other instrument is inserted into the keyway to operate the lock.

Figure 11B:
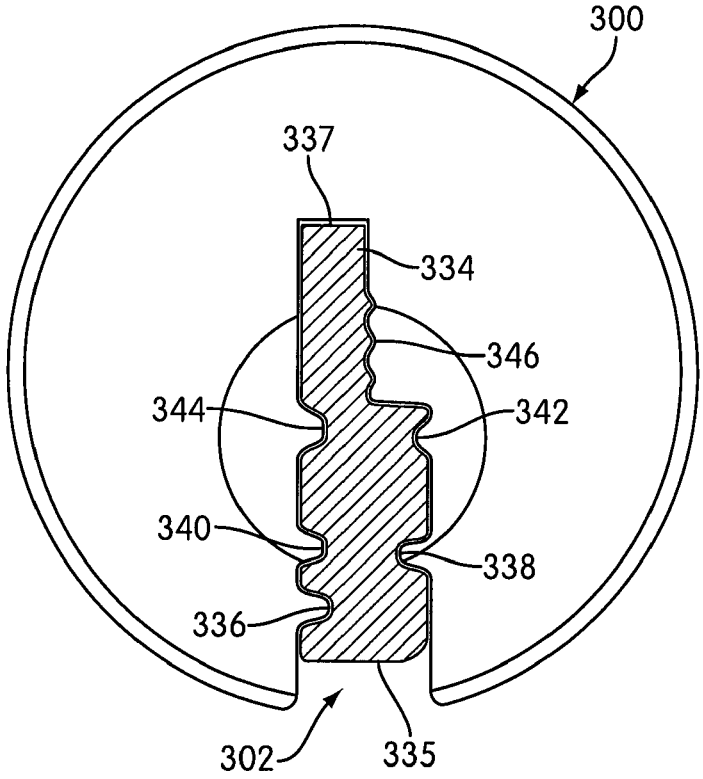
FIG. 11*b* is a cross-section along the line A-A of FIG. 11*a*.

FIG. 11*b* shows a cross-section of the key blade 334 inserted into the keyway 302 of the cylinder 300. Key blade 334 has a cross-section similar to that shown in FIG. 9, although key blades having cross-sections such as those shown in FIGS. 2-8 may also be used. As described above, the key blade 334 includes a first section near a bottom edge 335 of the blade having a groove 336 formed longitudinally along at least a portion of the blade 334. Groove 336, as described above, may be provided for registry purposes. A second section of the blade 334 includes a groove 338 formed longitudinally along at least a portion of the length of the blade. A third section extending to the top edge 337 of the blade 334 includes, on one side, straight angular grooves 340, 344 extending longitudinally along at least a portion of the blade and, on the opposite side, curved grooves and ridges 342, 346 formed longitudinally along at least a portion of the length of the blade. As described above, in the preferred embodiment, one side of the third section of blade includes only straight, angular, or rectangular grooves while the opposite side includes only curved grooves and ridges.

Figure 11C:
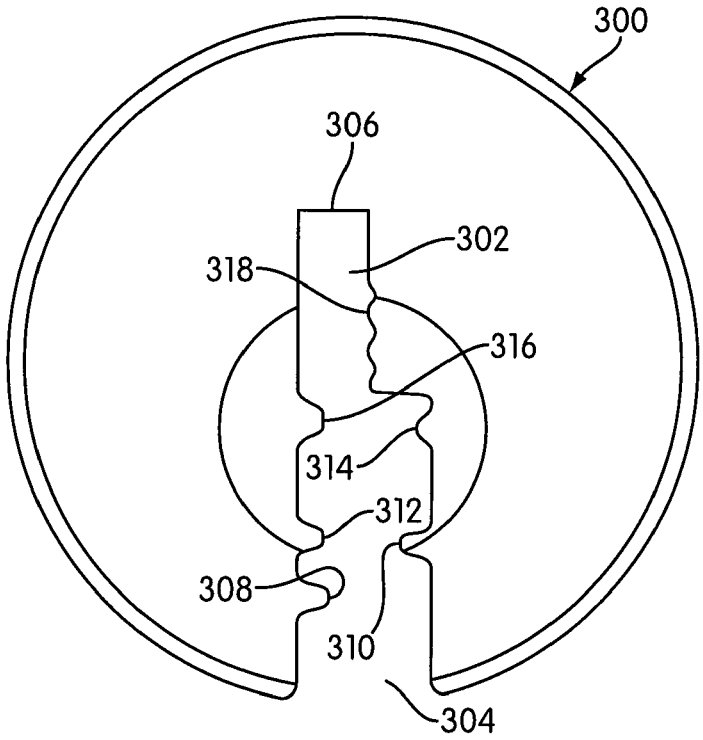
FIG. 11*c* is an end view of the lock cylinder of FIG. 11*b*, without the key inserted into the keyway.

FIG. 11*c* shows an end view of the cylinder 300 without the key blade 334 inserted therein. The cylinder 300 includes the keyway 302 having an open bottom end 304 and a closed top end 306. A first section of the keyway 302, adjacent the bottom end 304, includes a ridge 308 conforming to the groove 336 formed in the first section of the blade 334. A second section of keyway 302 includes a ridge 310 conforming to groove 338 formed in the second section of the blade 334. The third section of keyway 302, extending to the top end 306 of the keyway, includes, on one side thereof, ridges 312, 316 conforming to grooves 340, 344, respectively, formed on one side of the third section of the blade 334 and, on the opposite side of the keyway, ridges 314 and grooves 318 conforming to the grooves 342 and ridges 346, respectively, formed on the opposite side of the third section of the blade 334. In a preferred embodiment, ridges 312 and 316 formed on one side of the third section of the keyway 302 have only a straight angular shape (as shown) or a straight rectangular shape. The grooves 318 and ridges 314 formed on the opposite side of the keyway 302 in the third section have only curved shapes.

Figure 12A:
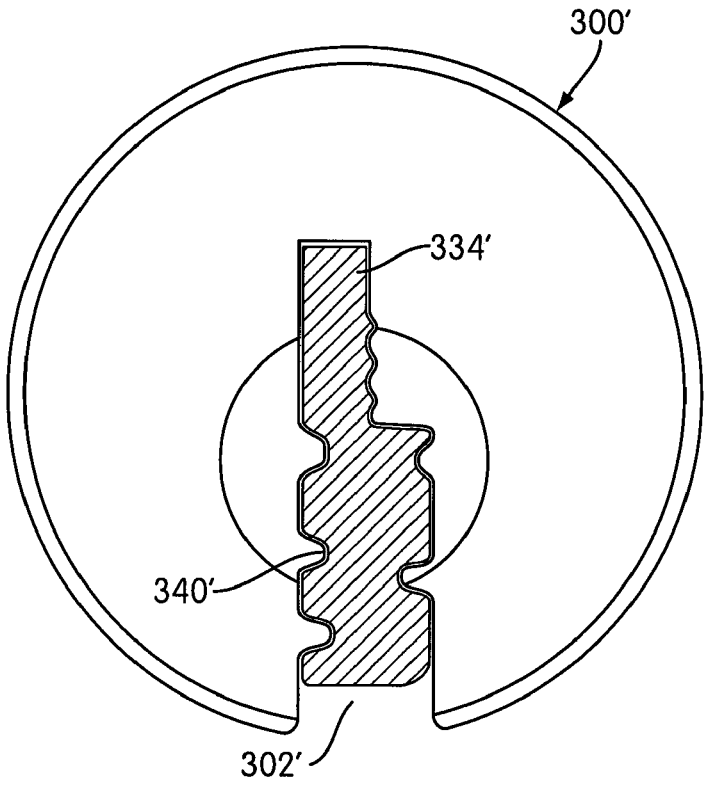
FIG. 12*a* is a cross-section of a key and keyway along the line A-A in FIG. 11*a*, showing a different key and keyway than what is shown in FIG. 11*b*.
Figure 12B:
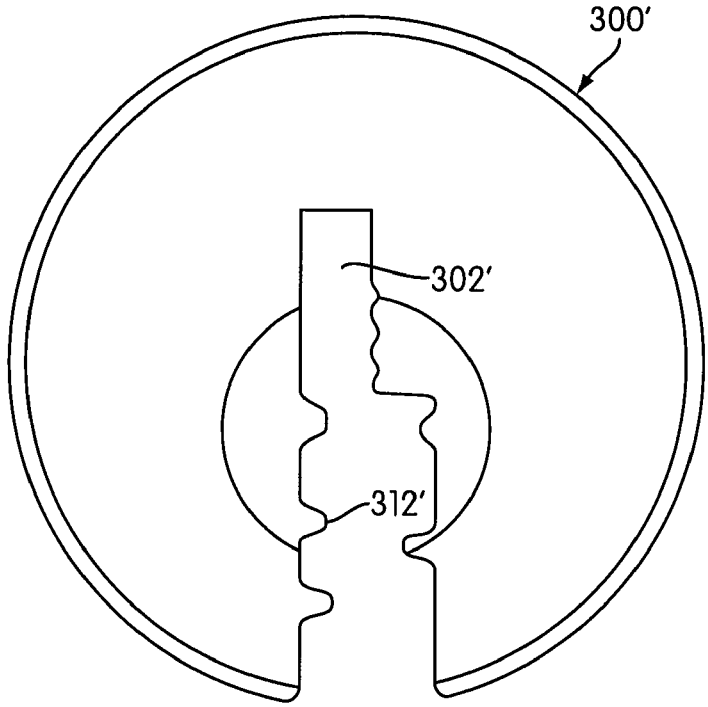
FIG. 12*b* is an end view of the lock cylinder of FIG. 12*a*, without the key inserted into the keyway.

FIGS. 12*a* and 12*b* show an end view of a cylinder 300' having a keyway 302'. FIG. 12*a* shows the cylinder 300' with a key blade 334' inserted into the keyway 302'. The key blade 334' is substantially identical to the key blade 334 shown in FIG. 11*b*, except that the groove 340' formed in the third section of the key blade 334' has a slightly higher position relative to the bottom edge 335 than the groove 340 formed in the key blade 334. Similarly, the ridge 312' extending into the keyway 302' conforms to the groove 340' formed in the third section of the blade 334' and is positioned higher along the keyway 302' than the ridge 312 of the keyway 302 shown in FIG. 11*c*.

Figure 13A:
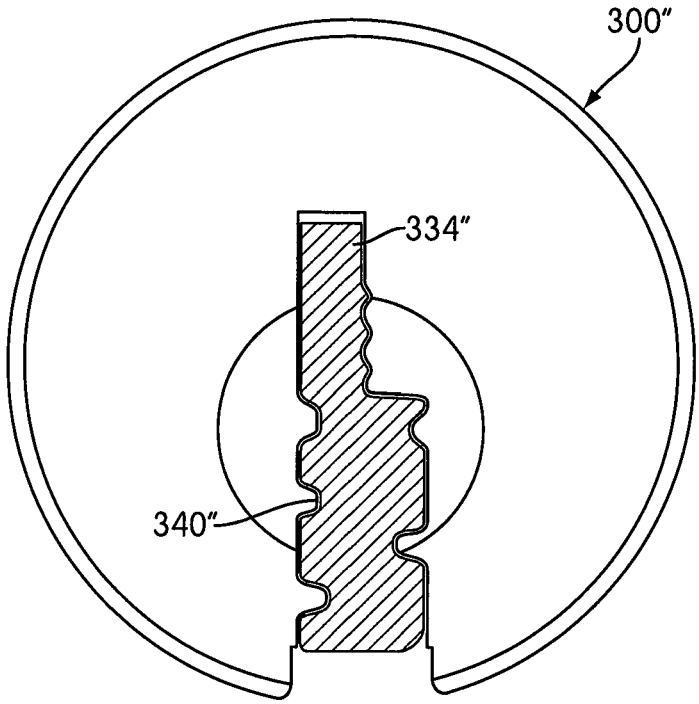
FIG. 13*a* is a cross-section of a key and keyway along the line A-A in FIG. 11*a*, showing a different key and keyway than what is shown in FIGS. 11*b* and 12*a*.
Figure 13B:
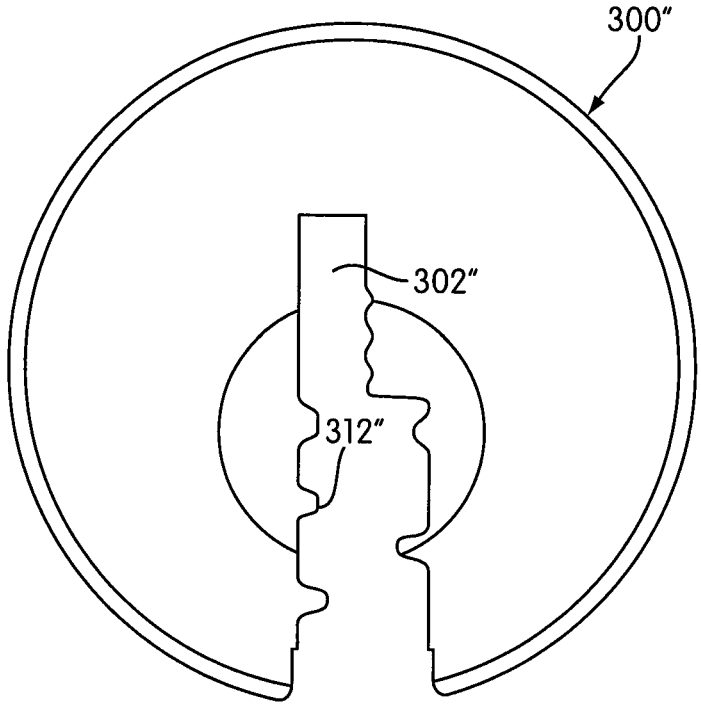
FIG. 13*b* is an end view of the lock cylinder of FIG. 13*a*, without the key inserted into the keyway.

FIGS. 13*a* and 13*b* show an end view of a cylinder 300" having a keyway 302". FIG. 13*a* shows the cylinder 300" with a key blade 334" inserted into the keyway 302". The key blade 334" is substantially identical to the key blade 334 shown in FIG. 11*b* and the key blade 334' shown in FIG. 12*a*, except that the groove 340" formed in the third section of the key blade 334" has a slightly higher position relative to the bottom edge 335 than the groove 340' formed in the key blade 334' and the groove 340 formed in the key blade 334. Similarly, the ridge 312" extending into the keyway 302" conforms to the groove 340" formed in the third section of the blade 334" and is positioned higher along the keyway 302" than the ridge 312 of the keyway 302 shown in FIG. 11*c* or the ridge 312' of the keyway 302' shown in FIG. 12*b*.

Figure 14A:
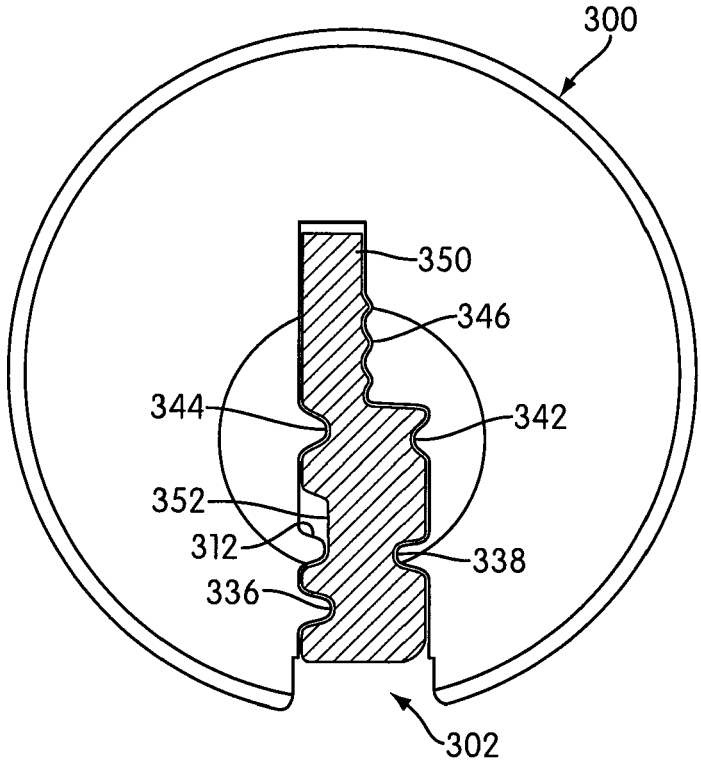
FIG. 14*a* is a cross-section of a key and keyway along the line A-A in FIG. 11*a*, wherein the keyway is the same keyway shown in FIGS. 11*b* and 11*c*, and the key is a master key.

FIG. 14*a* shows the cylinder 300 (as shown in FIG. 11*b*). As described above and shown in FIG. 11*c*, keyway 302 of cylinder 300 includes a first ridge 308 in the first section near the bottom 304 of the keyway, a ridge 310 in a second section of the keyway, and in a third section of the keyway extending to the top end 306, ridges 312 and 316 formed on one side of the keyway and curved grooves 318 and ridges 314 formed on the opposite side of the third section of the keyway. FIG. 14*a* shows a key blade 350 inserted into the keyway 302. Key blade 350 is essentially identical to key blade 334 shown in FIG. 11*b* and includes a groove 336 in a first section, a groove 338 in a second section, groove 344 formed in one side of a third section of the blade and grooves 342 and ridges 346 formed in the opposite side of the third section of the blade. Blade 350 differs from blade 334 in that, instead of having a groove 340 in the third section conforming to ridge 312 of the keyway 302, key blade 350 includes an enlarged groove 352 that accommodates the ridge 312 with excess room to spare.

Figure 15A:
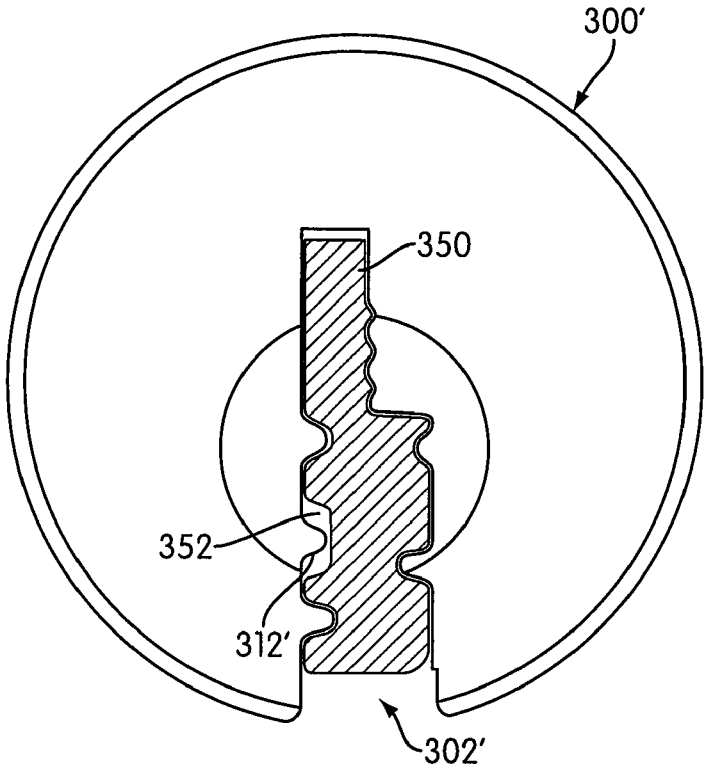
FIG. 15*a* is a cross-section of a key and keyway along the line A-A in FIG. 11*a*, wherein the keyway is the same keyway shown in FIGS. 12*a* and 12*b*, and the key is the master key shown in FIG. 14*a*.
Figure 16A:
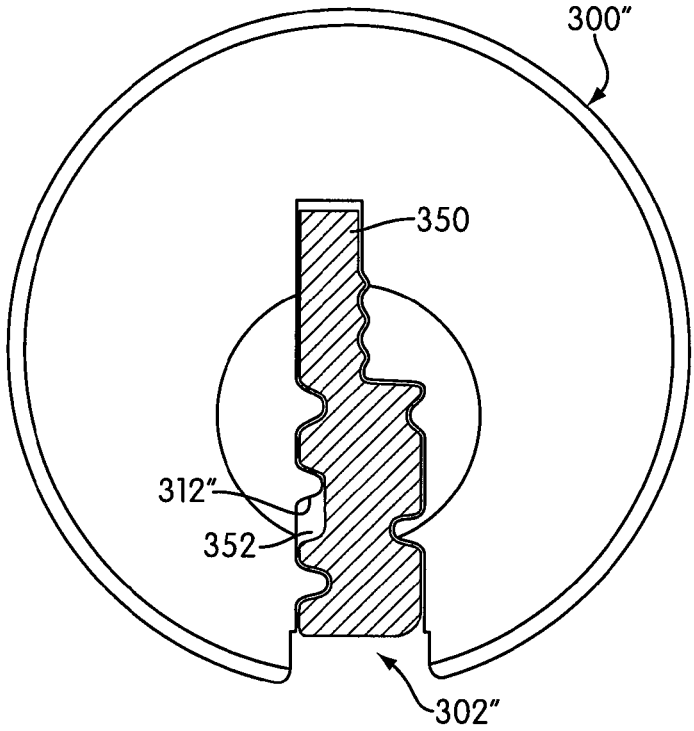
FIG. 16*a* is a cross-section of a key and keyway along the line A-A in FIG. 11*a*, wherein the keyway is the same keyway shown in FIGS. 13*a* and 13*b*, and the key is the master key shown in FIGS. 14*a* and 15*a*.

FIG. 15*a* shows the key blade 350 inserted into the keyway 302' of cylinder 300', and FIG. 16*a* shows the key blade 350 inserted into the keyway 302" of cylinder 300". As can be seen in the figures, the enlarged groove 352 formed in the key blade 350 accommodates all of the ridges 312, 312', 312". Accordingly, key blade 350 is a master key blade that will operate any of the cylinders 300, 300', 300".

A top edge of the blades 334 and 350 may have biting formed therein for positioning tumblers within the cylinder for operating the lock.

Figure 14B:
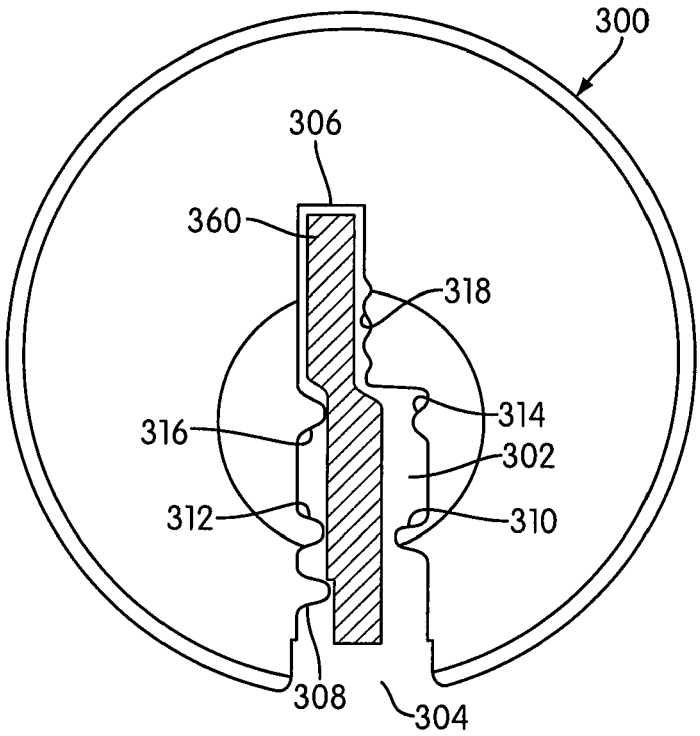
FIG. 14*b* is an end view of the keyway of FIG. 14*a* with an instrument inserted into the keyway for bypassing the profiles of the keyway.
Figure 15B:
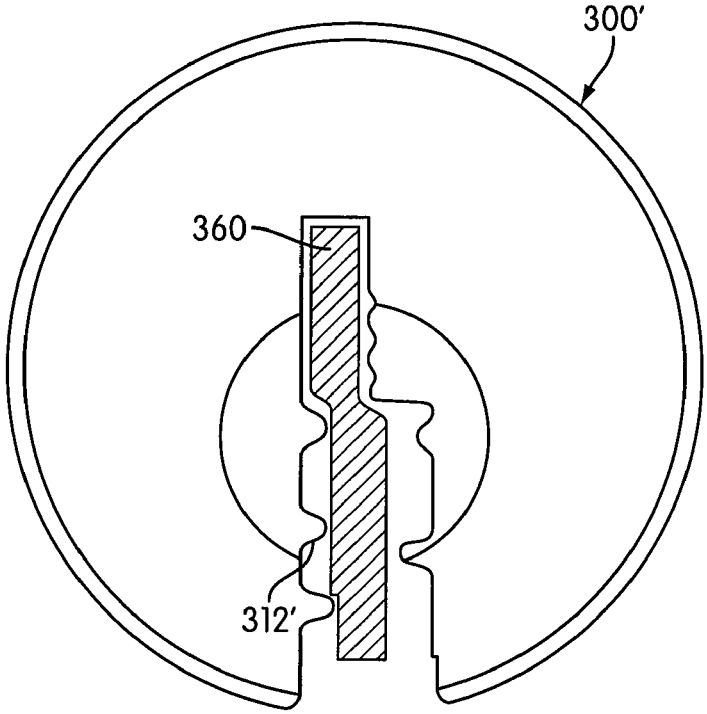
FIG. 15*b* is an end view of the keyway of FIG. 15*a* with an instrument inserted into the keyway for bypassing the profiles of the keyway.
Figure 16B:
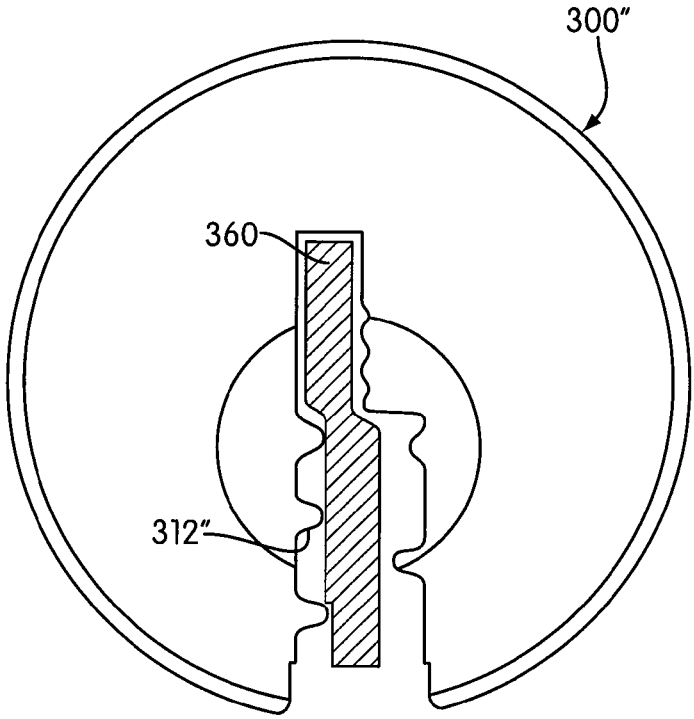
FIG. 16*b* is an end view of the keyway of FIG. 16*a* with an instrument inserted into the keyway for bypassing the profiles of the keyway.

FIGS. 14*b*, 15*b*, and 16*b* show lock cylinders 300, 300', 300", respectively, with a lock bypassing instrument 360 inserted into the keyway of each of the cylinders. More specifically, the instrument 360 includes a blade-like projection adapted to be inserted into the keyway, wherein the projection is sufficiently thin to fit into the keyways between the ridges of the keyway. The instrument 360 may have other features formed therein, such as bitting for positioning tumbler pins and a side projection for operating a slider within the keyway. Instrument 360 may thus be inserted into the keyway 302, 302', 302" and rotated to operate cylinder 300, 300', 300", respectively. Thus, the instrument 360 may be used to illicitly bypass the security provided by the unique combination of grooves and ridges formed in the keyway which is intended to be opened only by a properly conforming key having conforming grooves and ridges. The illustrated embodiment is exemplary. The instrument used to open the lock may take forms different from that shown in FIGS. 14*b*, 15*b*, and 16*b* and may comprise two or more pieces used in conjunction to open the lock as opposed to the single integrally-formed device (instrument 360) shown.

Further variations and modifications of this invention will be apparent to those with ordinary skill in the art of keys and master keying for mechanical locks.

What is claimed is:

1. A lock system comprising:

one or more keys including a generally flat-sided blade, said blade having a top edge, a bottom edge, and opposite sides for receiving grooves and ridges which define a cross-sectional shape of the blade, wherein the blade is divided into three or more sections between the bottom edge and the top edge, and wherein the sections comprise:

a first section having a registry groove for registering the key blade by holding the key blade in a reference position during machining of the blade;

a second section having a groove; and a third section having on a first side thereof only curved longitudinal grooves and ridges both defining a curvilinear profile, and on a second side thereof grooves with only substantially rectangular or straight angular shapes; and one or more locks having a keyway for receiving the key blade of said key, said blade being constructed and arranged to operate said lock, and wherein said keyway is divided into three or more sections along its height, said sections comprising:

a first section having a ridge conforming to the registry groove of the first section of said blade;

a second section having a ridge conforming to the groove of the second section of said blade; and a third section having on a first side thereof only curved ridges and grooves conforming to the curved grooves and ridges, respectively, of the first side of the third section of said blade, and on a second side thereof ridges with only substantially rectangular or straight angular shapes conforming to the grooves of the second side of the third section of said blade.

2. The lock system of claim 1, wherein the three sections of the key blade are adjacent to one another, the first section staffing at the bottom edge of the key blade and extending upwardly, the second section adjacent the first section and in the middle of the key blade, and the third section between the second section and the top edge of the key blade.

3. The lock system of claim 1, comprising two or more keys, wherein at least one groove or ridge in at least one section of the blade of one key is shifted up or down relative to a bottom edge of the key blade compared to the position of a similar configuration on the other blade to create variations in key blanks within a hierarchical lock system.

4. The lock system of claim 1, comprising two or more keys, wherein the substantially rectangular or straight angular shapes formed in the third section of one blade are of different depths and different angles as compared to the other blade to create further variations in key blade within a hierarchical lock system.

5. The lock system of claim 1, wherein the groove formed in the second section is an undercut groove extending along a length of the blade.

6. The lock system of claim 1, comprising two or more keys, wherein at least one groove in at least one section of the blade of one key is shifted up or down relative to a bottom edge of the key blade compared to the position of a similar groove on the other blade to create variations in key blanks within a hierarchical lock system, said system further comprising at least one lock having a keyway conforming to each of said two or more keys.

7. The lock system of claim 1, further comprising a master key conforming to all keyways of the lock system.

8. A lock system comprising:

a lock having a keyway for receiving a key blade of a key, and wherein said keyway is divided into three or more sections along its height, said sections comprising:

a first section having a ridge projecting into the keyway and conforming to a registry groove of a key blade;

a second section having a ridge projecting into the keyway and configured to define a primary family of the lock system; and a third section having on a first side thereof only curved ridges and grooves and on a second side thereof ridges projecting into the keyway with only substantially rectangular or straight angular shapes; and a key including a generally flat-sided blade, said blade having a top edge, a bottom edge, and opposite sides, said blade being configured to be inserted into said keyway of said lock and to enable a user to operate said lock with said key.

9. The lock system of claim 8, wherein said key blade is divided into three or more sections between the bottom edge and the top edge, and wherein the sections comprise:

a first section having a registry groove conforming to the ridge formed in the first section of the keyway and for registering the key blade by holding the key blade in a reference position during machining of the blade;

a second section having a groove conforming to the ridge formed in the second section of the keyway; and a third section having on a first side thereof only curved longitudinal grooves and ridges both conforming to the ridges and grooves, respectively, of the first side of the third section of the keyway, and on a second side thereof grooves with only substantially rectangular or straight angular shapes and conforming to the ridges of the second side of the third section of the keyway.

10. A method for operating a lock comprising:

providing a lock having a keyway for receiving a key blade of a key, the keyway being divided into three or more sections along its height, the sections comprising:

a first section having a ridge projecting into the keyway and conforming to a registry groove of a key blade;

a second section having a ridge projecting into the keyway and configured to define a primary family of a lock system that includes the lock; and a third section having on a first side thereof only curved ridges and grooves and on a second side thereof ridges projecting into the keyway with only substantially rectangular or straight angular shapes; and providing an instrument including at least a portion thereof configured to be inserted into said keyway of said lock and to enable a user to operate said lock with the instrument.

11. The method of claim 10, wherein the portion of the instrument configured to be inserted into the keyway comprises a top edge, a bottom edge, and opposite sides for receiving grooves and ridges which define a cross-sectional shape of the portion and is divided into three sections between the bottom edge and the top edge, and wherein the sections comprise:

a first section having a groove conforming to the ridge of the first section of the keyway, a second section having a groove conforming to the ridge of the second section of the keyway; and a third section including a first side having only curved ridges and grooves conforming to the curved grooves and ridges, respectively, of the first side of the third section the keyway, and a second side having grooves with only substantially rectangular or straight angular shapes conforming to the ridges of the second side of the third section of the keyway.

12. The method of claim 10, wherein the portion of the instrument configured to be inserted into the keyway is sufficiently thin so as to fit into the keyway between the ridges of the keyway.

13. A method for operating a lock including a cylinder with a keyway configured to receive a conforming key blade that is divided into three or more sections between a bottom edge and a top edge thereof, the sections including a first section having a registry groove for registering the conforming key blade by holding the blade in a reference position during machining, a second section having a groove, and a third section having on a first side thereof only curved longitudinal grooves and ridges both defining a curvilinear profile and on a second side thereof grooves with only substantially rectangular or straight angular shapes, wherein the cylinder is constructed and arranged to be operated by a user inserting the conforming key blade into the keyway and rotating the cylinder, said method comprising:

providing an instrument including at least a portion thereof configured to be inserted into the keyway of the lock and to enable a user to operate the lock with the instrument;

inserting the instrument into the keyway, wherein the keyway is divided into three or more sections along its height, including a first section having a ridge conforming to the registry groove of the first section of the conforming key blade, a second section having a ridge conforming to the groove of the second section of the blade; and a third section including a first side having only curved ridges and grooves conforming to the curved grooves and ridges, respectively, of the first side of the third section of the blade and a second side thereof having ridges with only substantially rectangular or straight angular shapes conforming to the grooves of the second side of the third section of the blade; and manipulating the instrument to operate the cylinder of the lock.

14. The method of claim 13, wherein the portion of the instrument configured to be inserted into the keyway comprises a top edge, a bottom edge, and opposite sides for receiving grooves and ridges which define a cross-sectional shape of the portion and is divided into three sections between the bottom edge and the top edge, and wherein the sections comprise:

a first section having a groove conforming to the ridge of the first section of the keyway, a second section having a groove conforming to the ridge of the second section of the keyway; and a third section including a first side having only curved ridges and grooves conforming to the curved grooves and ridges, respectively, of the first side of the third section the keyway, and a second side having grooves with only substantially rectangular or straight angular shapes conforming to the ridges of the second side of the third section of the keyway.

15. The method of claim 13, wherein the portion of the instrument configured to be inserted into the keyway is sufficiently thin so as to fit into the keyway between the ridges of the keyway.

16. The method of claim 13, wherein the instrument comprises a single, integrally formed device.

* * * * *

UNITED STATES PATENT AND TRADEMARK OFFICE

CERTIFICATE OF CORRECTION

PATENT NO. : 7,552,608 B2
APPLICATION NO. : 12/141427
DATED : June 30, 2009
INVENTOR(S) : Peter H. Field et al.

It is certified that error appears in the above-identified patent and that said Letters Patent is hereby corrected as shown below:

Claim 2, Col. 9, line 12, change "staffing" to --starting--.

Signed and Sealed this

Tenth Day of November, 2009

David J. Kappos

David J. Kappos
*Director of the United States Patent and Trademark Office*